United States Patent [19]

Bataille et al.

[11] Patent Number: 4,782,315

[45] Date of Patent: Nov. 1, 1988

[54] BISTABLE POLARIZED ELECTROMAGNET

[75] Inventors: Christian Bataille, Ville d'Avray; Michel Lauraire, Courbevoie; Elie Belbel, Epinay sur Seine, all of France

[73] Assignee: La Telemecanique Electrique, France

[21] Appl. No.: 121,719

[22] Filed: Nov. 17, 1987

[30] Foreign Application Priority Data

Nov. 19, 1986 [FR] France ..... 86 16071

[51] Int. Cl.[4] ..... H01F 7/08

[52] U.S. Cl. ..... 335/234; 335/79

[58] Field of Search ..... 335/78, 79, 80, 81, 335/229, 230, 234

[56] References Cited

U.S. PATENT DOCUMENTS 4,097,833 6/1978 Myers ..... 335/261

FOREIGN PATENT DOCUMENTS 56-36109 4/1981 Japan ..... 335/230

*Primary Examiner*—George Harris

*Attorney, Agent, or Firm*—William A. Drucker

[57] ABSTRACT

A bistable polarized electromagnet is provided having a mobile armature with a permanent magnet and pole pieces which cooperate with a fixed yoke through two pairs of air gaps for each of which one is variable whereas the other is substantially constant. This electromagnet may further have asymmetric or symmetric forms of revolution for easy replacement of the excitation coil.

7 Claims, 6 Drawing Sheets

BISTABLE POLARIZED ELECTROMAGNET

BACKGROUND OF THE INVENTION

1. Field of the Invention

The invention relates to a bistable polarized electromagnet having a fixed magnetizable circuit which is excited by an associated coil through which an electric current flows with one of two possible polarities, and a mobile armature having a permanent magnet on the two opposite pole faces of which are connected two respective pole pieces, this armature being adapted to move longitudinally between two positions in each of which these pole pieces cooperate with distinct portions of a fixed circuit through two air gaps placed in series, one at least of which is variable.

2. Description of the Prior Art

Such electromagnets are widely used in industrial installations and automated systems, for example for reducing energy consumption and for ensuring that the circuits retain their state should power sources fail, and may be illustrated for example by the French Pat. No. 2358006 in which the two variable air gaps are placed in series and vary simultaneously, whereas in each of the two stable states the flux of the permanent magnet closes on a magnetic circuit with negligible reluctance. In such an electromagnet, replacement of the coil is not easy because of the presence of projecting pole pieces.

Furthermore, the presence of two air gaps placed in series means that the coil must develop a sufficiently high number of ampere-turns to oppose the flux developed by the magnet, while allowing it to flow through two reluctances placed in series; in this known apparatus, a certain technical difficulty is further met with in so far as correct simultaneous application of the pole pieces on the magnetic circuit is concerned, because of the distance which separates them.

DE-A-3 508 768 describes a polarized electromagnet having a polarized mobile piece without pole extensions, and with two sliding air gaps of constant thickness. No magnetically stable position is conferred on the mobile piece, which further requires, for its movements, the presence of two symmetric magnetizable systems, so of two coils. The mobile piece, which does not have a variable air gap, is only subjected to low tangential components of traction or repulsion forces which develop perpendicularly to the direction of movement; a limit to the movement is only provided by the meeting of feet associated with the ends of openings.

The electromagnet described in the application EP-A-179911, in the embodiment shown in FIG. 5, has a single coil (11) for causing excitation of a fixed magnetic circuit (7) having a working air gap of variable thickness (13) and a flux closure air gap (15) of constant thickness for causing the movements of a mobile armature formed by a permanent magnet (46) and by two opposite pole pieces (45).

In the structure described, the longitudinal arrangement of the polarization of the magnet requires the use of transverse pole pieces only the edges of which cooperate with the fixed circuit, so that the corresponding reluctances are high.

Furthermore, the fluxes developed by the permanent magnet in each of the two end positions of the armature (FIGS. 5*a* and 5*b*) are largely magnetically short circuited by the presence of air gap pairs which, in these positions, do not contribute to maintaining stable positions. No guide for the mobile armature is described.

In the embodiment shown in FIG. 3, the orientation of the permanent magnets is transversal, but no pole piece is associated with the permanent magnet for reducing the reluctance of the constant thickness air gap. In each of the two stable positions, the presence of a residual air gap prevents the development of a holding flux, whereas no information is given concerning the location of the guide means.

SUMMARY OF THE INVENTION

The invention consequently provides an electromagnet having the general construction mentioned above and in which measures will be taken, on the one hand, for reducing the volume of the coil and, on the other, for overcoming the technical difficulties which appear when it is desired to obtain simultaneous closure of two air gaps which are not situated in the same plane; furthermore, the invention also keeps the advantage which results in a way know per se from the use of the same magnets for stabilizing the armature in its two end positions.

The invention provides then a bistable polarized electromagnet having a fixed magnetizable circuit excited by a coil so as to give opposite magnetic polarizations to two pieces of this circuit placed facing each other, and a mobile armature which includes a permanent magnet whose internal flux flows parallel to these pieces and which moves between these two pieces so as to have a working air gap of variable thickness and a sliding closure air gap of substantially constant thickness, placed in series with the first one, wherein the closure air gap, which has a low reluctance conferred by a first pole piece fast with the magnet, is disposed in the vicinity of means for guiding the armature, this first pole piece, as well as a second pole piece fast with said magnet serving for channeling a holding flux in each of the two stable positions.

Subsidiarily, the invention relates to embodiments either for reducing the reluctance of the air gaps, whose value is by construction substantially constant, or for forming magnetizable circuits only requiring the application of a reduced number of ampere turns, or else for constructing the electromagnet in forms adapted for reducing the parasite attraction forces which develop between the two adjacent surfaces of air gaps of small thickness.

Electromagnets are already known, for example from the patent FR No. 2 568 402, in which measures are taken for reducing the ampere turns developed by the coil through the arrangement of two air gaps one of which, having a variable reluctance for generating attraction forces, is placed in series with a second sliding air gap, whose reluctance is low and substantially constant; in such an electromagnet where the magnetizable circuits only have a single flow channel for the flux of the coil, a permanent magnet cannot be directly incorporated in this circuit without establishing in one or other of its states an opposition of the two fluxes developed by the coil and respectively by the magnet.

BRIEF DESCRIPTION OF THE DRAWINGS

The invention as well as the different embodiments to which it lends itself, will be better understood from reading the following description with reference to the accompanying Figures which illustrate.

DESCRIPTION OF THE PREFERRED EMBODIMENTS

Figure 3:
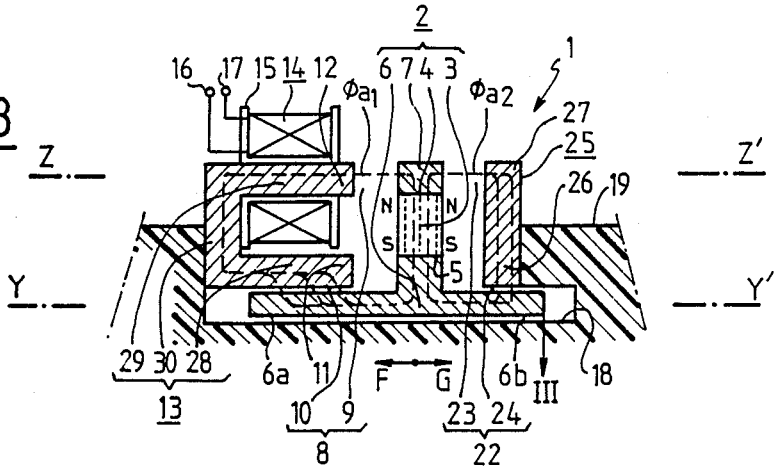

In a first embodiment 1 of an electromagnet of the invention, shown more particularly in FIG. 3, a mobile armature 2 is guided longitudinally along a slide 18 belonging to a case 19 in longitudinal directions F and G.

This armature, shown in this Fig. in an unstable intermediate position —III—includes a permanent magnet 3 with transversly opposite pole faces 4, respectively 5, which are respectively connected to magnetizable pole pieces 7 and 6; pole piece 6 itself has two opposite extensions 6*a*, 6*b* one of which 6*a* cooperates through a constant air gap 10, whose reluctance is low and substantially constant when the armature moves, with a first branch 28 of a fixed magnetizable circuit 13 having a second branch 26.

With this magnetizable circuit 13 is associated an excitation coil 14 which is wound in a way known per se on a carcase 15 placed about a branch 29, and has two supply terminals 16, 17.

Between one end 12 of branch 29 and pole piece 7 is situated a variable air gap 9 whose reluctance varies depending on the position of the armature.

The second extension 6*b* cooperates, through an air gap 24 whose reluctance is low and substantially constant, with one end 26 of a second fixed magnetizable piece 25; the second magnetizable piece further has an other end 27 which is placed opposite the pole piece 7, and is separated therefrom by an air gap 23 whose reluctance varies depending on the longitudinal position of the armature.

This Fig. illustrates again the existence of two pairs of air gaps 8 and 22, in which each pair includes an air gap with variable reluctance 9 respectively 23 and an air gap 10 respectively 24 with low and substantially constant reluctance. Air gaps 10 and 24 are formed by closely spaced surfaces parallel to the direction F, G.

Although, particularly for balancing reasons, one or more resilient members acting in direction F or G may be associated with the armature, these members will not play a part in the balance of the forces which are exerted thereon, when opposite excitations are communicated to the coil and to the circuits because of the flow of a current therein in one direction or in the other.

The operation of the electromagnet 1 will be explained with reference to FIGS. 1, 2 and 3 which include circuits shown with continuous lines for representing the flux $\phi_B$ developed by the coil, and circuits shown with broken lines representing those $\phi_a$, $\phi_{a1}$, $\phi_{a2}$ which are developed by the permanent magnet.

Figure 1:
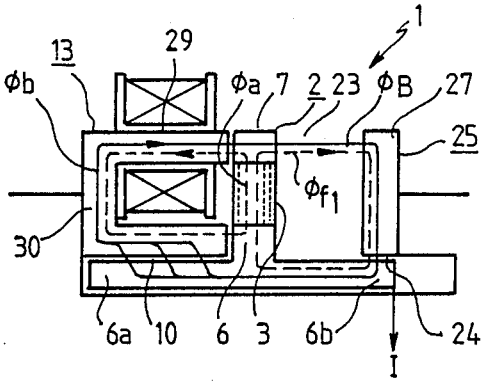
In FIGS. 1, 2 and 3, a first asymmetric embodiment of an electromagnet of the invention shown in its two stable states and for an intermediate position of the armature.

In one of the stables states —I— shown in FIG. 1, the flux $\phi_a$ of the magnet is closed through the pole piece 7, branch 29, core 30, branch 28, the low reluctance air gap 10, extension 6*b* and pole piece 6, for pieces 7 and 12 are practically in contact and a force of attraction applies the armature against the fixed circuit 13; a low leak flux $\phi_{f1}$ is further closed through the fixed piece 25.

When a current flows in an appropriate direction through coil 14, flux $\phi_B$ flows through core 30, branch 29, air gap 23, piece 25, air gap 24, the extensions 6*b* , 6*a* and air gap 10; such a flow implies that air gaps 24 and 10 have a very low reluctance and that flux $\phi_B$, which cannot flow through the magnet, is developed by sufficient coil ampere turns to overcome the reluctance of the air gap 23, which is relatively greater.

When these ampere turns are sufficiently high, a magnetic polarity appearing at end 27 attracts the pole piece 7; this phenomenon occurs as soon as $\phi_B$ becomes greater than $\phi_a$, and the armature moves then in direction G.

It will be noted that when this movement takes place, the reluctance of air gap 23 decreases, whereas a reluctance appears in air gap 9.

So that the movement may continue, the overall reluctance $R_g$, allowing flux $\phi_B$ to flow and then bringing into play two partial reluctances in series, should not substantially increase.

As the armature moves away from the fixed circuit 13, the flux $\phi_a$ decreases because of the appearance of air gap 9 and the attraction undergone in direction F by this armature also decreases.

Figure 4:
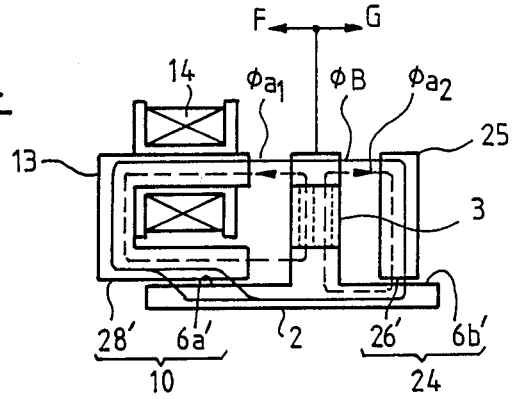
FIG. 4, a view of the electromagnet which corresponds to the position of the armature defined in FIG. 3, and where the division of flows of different origins is shown.

For a particular position —III—of the armature, shown in FIGS. 3 and 4, the flux of the magnet is divided into two fluxes $\phi_{a1}$, $\phi_{a2}$, flowing respectively through the fixed circuit 13 and through the fixed circuit 25, so that the driving actions in direction F and in direction G developed by this magnet are equal and opposite in direction.

It is sufficient subsequently for excitation of the coil to be maintained until the moment when the movement in direction G of the armature brings it slightly beyond this particular position —III—for the flux $\phi_{a2}$ to become preponderant and then attract the armature to a position close to the fixed piece 25; in the corresponding stable state —II—shown in FIG. 2, the armature is then still held by the permanent magnet. Residual air gaps, $23_r$ respectively $9_r$ of small thickness may be advantageously established between the pole pieces 7 and the ends 12, respectively 27 in order to attenuate the adherence effects and facilitate take off of the armature in one or other direction.

The return of the armature from position —II—to the original position —I—is also caused through an excitation of short duration of the coil which has then a current flowing therethrough in the direction opposite the preceding one.

Figure 2:
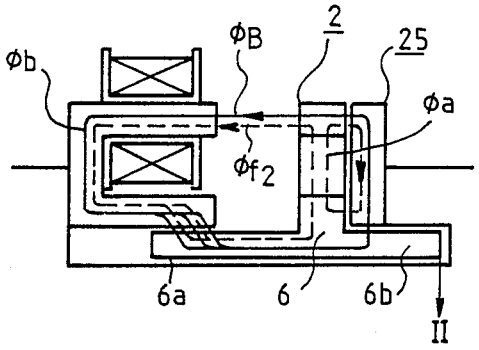

During this operation, the flow of flux $\phi_B$ changes direction, see FIG. 2, and is closed more particularly through the fixed piece 25 in a direction opposite the flux $\phi_a$ of the permanent magnet, so that this latter is forced to close through the pole piece 4, the air gap 9, the fixed magnetizable piece 13, air gap 10 and the extension 6*a* of pole piece 6.

The two fluxes, which are then additive in portions 4, 13, 10 and $6_a$, cause the appearance of attraction forces which are applied in direction F to armature 2 and cause its initial movement in this direction.

In a way comparable to that described above, but in opposite directions, the flux $\phi_{a2}$ decreases, and the flux $\phi_{a1}$ increases, whereas the flux $\phi_B$ remains substantially constant; hereagain, it is therefore not necessary to maintain a current flow in the coil beyond a particular position of the armature, which is substantially adjacent the preceding one, see FIG. 4, for the movement of this latter in direction F to continue by itself and solely because of the presence of the permanent magnet.

The U shape given here to the yoke 13 allows coil 14 to be replaced by relative movements thereof in directions F and G.

Figure 5:
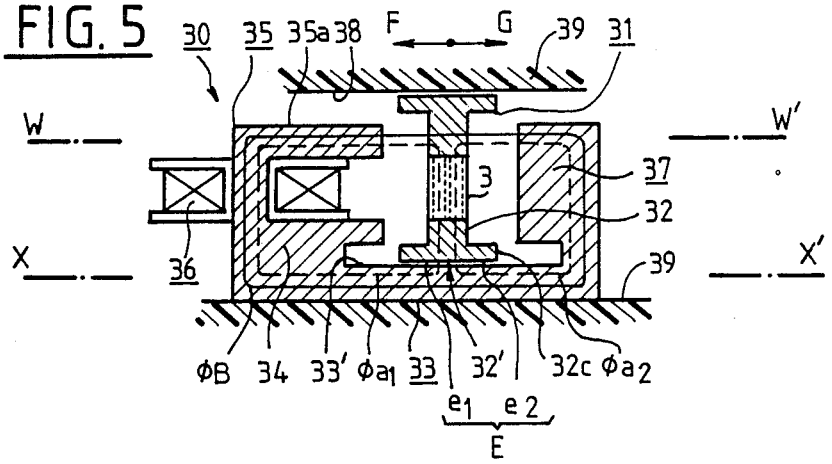
In FIG. 5, a second asymmetric embodiment of the electromagnet, in which the magnetizable circuit associated with the coil is modified.

In a variant of construction 30 of the invention, which is shown in FIG. 5, in which the armature 31 of the electromagnet is in its balanced position, the low reluctance sliding air gaps referenced above 10 and 24 are no longer present and the pole piece 32 of armature 31 is associated by a single air gap E of low reluctance with a magnetizable cross piece 33 which connects the branch 34 of the fixed magnetizable circuit 35 associated with coil 36 longitudinally with the second fixed piece 37. In this embodiment, the mobile armature 32 may be guided longitudinally in directions F and G in the case, through the presence of a slide in case 39 shown schematically at 38.

This embodiment is advantageous to the extent that it allows the mass of the armature to be decreased by requiring only a single air gap of low reluctance E; this latter however combines the functions of the two preceding air gaps, as is shown with broken lines by the division of the flux of the magnet into two fluxes $\phi_{a1}$ and $\phi_{a2}$ flowing through two neighbouring air gaps $e_1$ and $e_2$.

The operating mode of this variant is quite comparable to that of the preceding one: however, it will be noted that, for the same flux $\phi_B$ developed in circuits 34, 37, it will not be necessary to apply as high a number of ampere turns as before, considering the disappearance of the air gaps placed before at 9 and 24.

In the embodiments 1 and 30 of the invention, the means used for providing longitudinal guidance of the armature must take into account the existence of transverse traction forces which are developed between the magnetizable pieces separated by the sliding air gaps 10, 24 on the one hand and E on the other; the parasite lateral forces generate additional friction. Furthermore, removal of coil 36 is not directly possible, unless the yoke 35 has a pole piece 35*a* which may be dissociated from branch 34.

Figure 6:
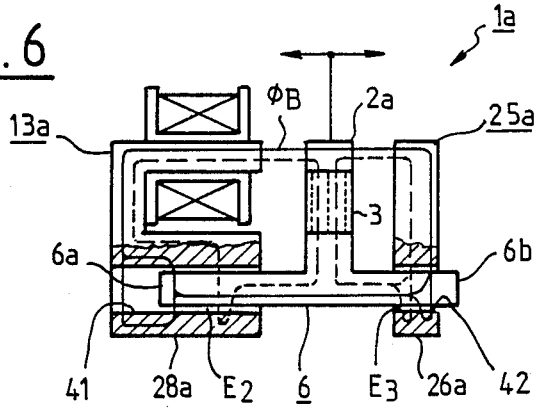
In FIG. 6, an electromagnet whose construction corresponds to that of FIGS. 1 to 4 in which measures are taken for reducing parasite attraction forces.

One of the means which may be used for very substantially reducing these parasite lateral forces in one embodiment 1*a*, see FIG. 6, consists in causing extensions 6*a*, 6*b* to pass through two openings 41, 42 of similar sections which will be formed in a leg 28*a* of the fixed circuit 13*a* and respectively in the end 26*a* of the fixed piece 25*l*.

Figure 7:
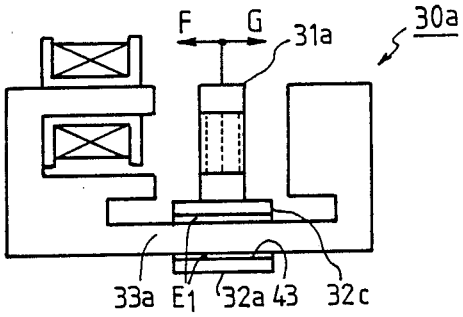
In FIG. 7, an electromagnet whose construction corresponds to that of FIG. 5 and in which measures are taken for reducing parasite attraction forces.

In another embodiment 30*a* derived from that of FIG. 5 and shown in FIG. 7, the pole piece 32*a* of armature 31*a* is provided with an opening 43 surrounding, with an air gap of small reluctance $E_1$, a cross piece 33*a* of similar section.

If it is further desired to cause these new sliding air gaps to provide a longitudinal and transverse mechanical guidance function, rings made from an antifriction material may for example be disposed there, the openings and the cross pieces then advantageously having mating circular sections.

In two other embodiments 50 and 60, which derive from those illustrated from FIGS. 5 and 1, by giving to the fixed and mobile pieces forms of revolution, the electromagnets advantageously have the form of magnetizable pots where balancing of the attraction forces and efficient and economic guidance are provided simultaneously.

Figure 8:
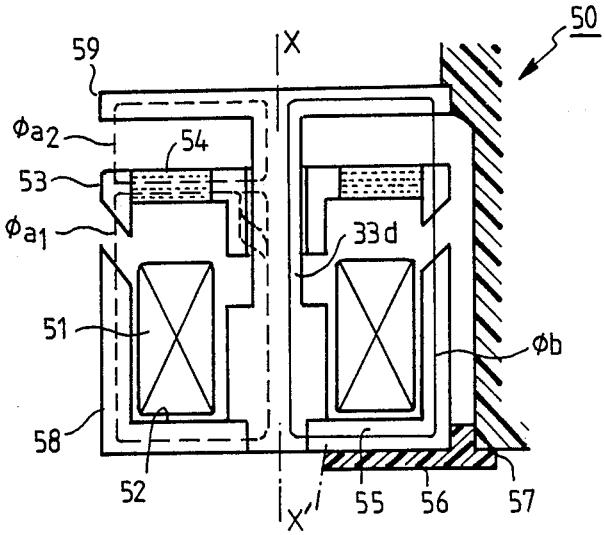
In FIGS. 8 and 9, two third embodiments which derive from those shown in FIGS. 1 and 5 when their elements are given forms of revolution about adjacent axes of the sliding air gaps.
Figure 9:
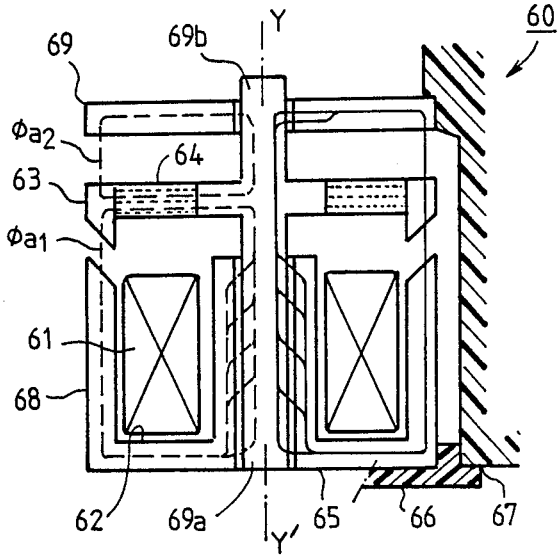

In these embodiments, shown in FIGS. 8 and 9, the axis of symmetry XX', respectively YY' passes substantially through the pole piece 6 or respectively cross piece 33, described above, and the coils 51 respectively, 61 are housed in annular cavities 52, respectively 62 concentric with XX', respectively YY'.

Figure 14:
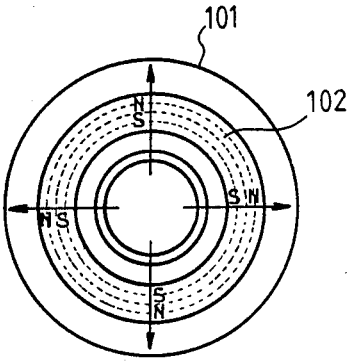
In FIGS. 14 and 15 two side views of armatures having forms of revolution and using permanent magnets with different shapes; and In FIGS. 16 and 17, two sectional views of armatures having forms of revolution and an axial orientation of their magnetic poles.
Figure 15:
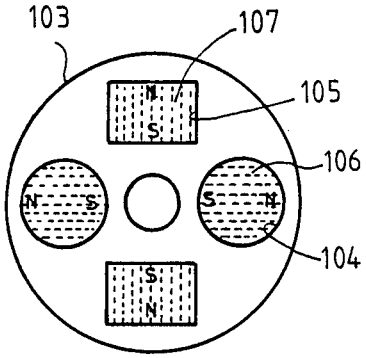

The armatures 53, respectively 63 here include permanent magnets 54, respectively 64 having for example annular forms shown in FIG. 14.

Figure 10:
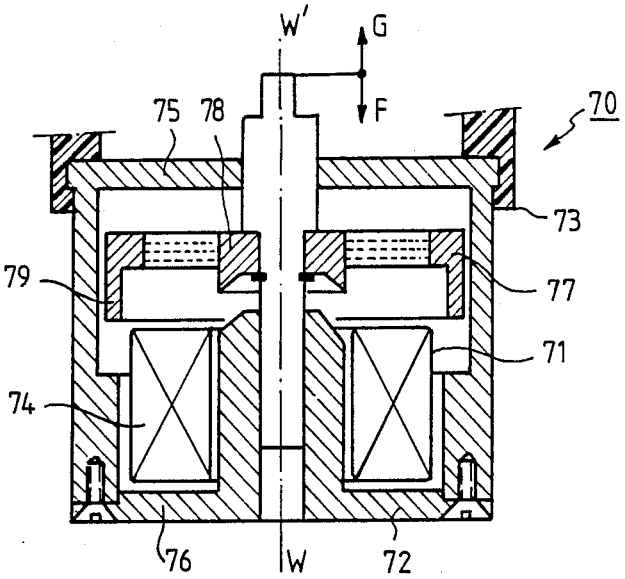
In FIGS. 10 and 11, two fourth embodiments which derive from those shown in FIGS. 1 and 5 when their elements are given forms of revolution about axes passing through the working air gaps.
Figure 11:
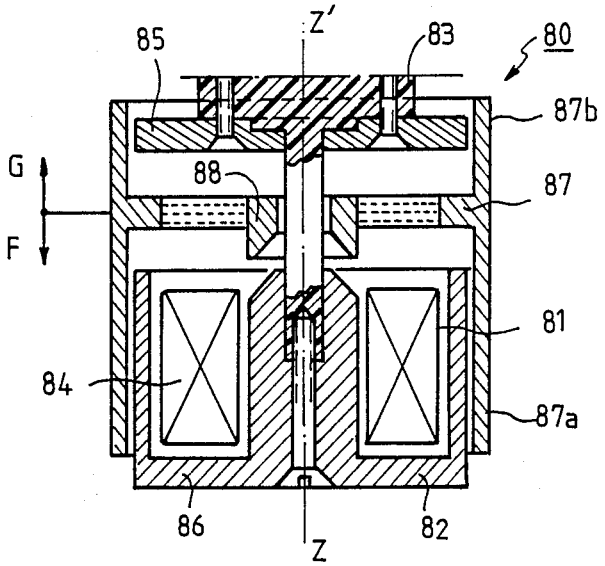

In two other embodiments 70 and 80 which are shown in FIGS. 10 and 11, which derive also from those illustrated in FIGS. 1 and 5, by giving to the fixed and mobile pieces forms of revolution about axes WW' respectively ZZ' passing longitudinally through the legs 29 respectively 43, advantages are obtained comparable to those obtained by the embodiments 50 and 60.

One advantage common to embodiments 50, 60, 70, 80 is that they allow coils 51, 61, 71, 81 to be readily changed because of the presence of removable bottoms 55, 65, 72, 82 and respectively lids 56, 66 placed in accessible regions on cases 57, 67, 73, 83 adapted so as to maintain the other fixed and irremovable pieces in position.

Figure 12:
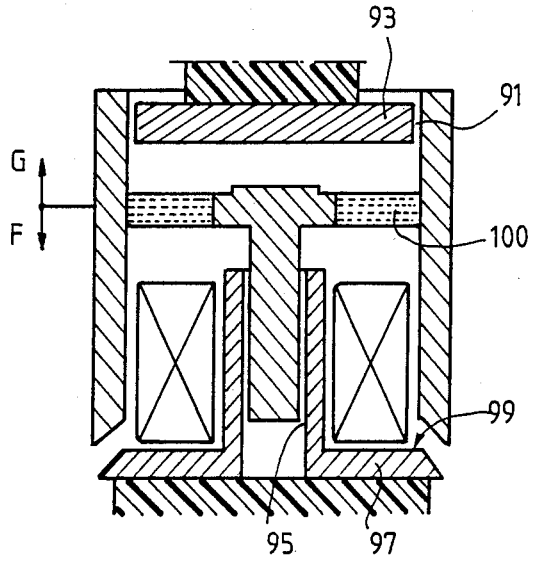
In FIGS. 12 and 13, two fifth embodiments which, within the scope of electromagnetic elements having forms of revolution, use two sliding air gaps situated one in the vicinity of the axis of symmetry and the other at a distance close to the periphery.
Figure 13:
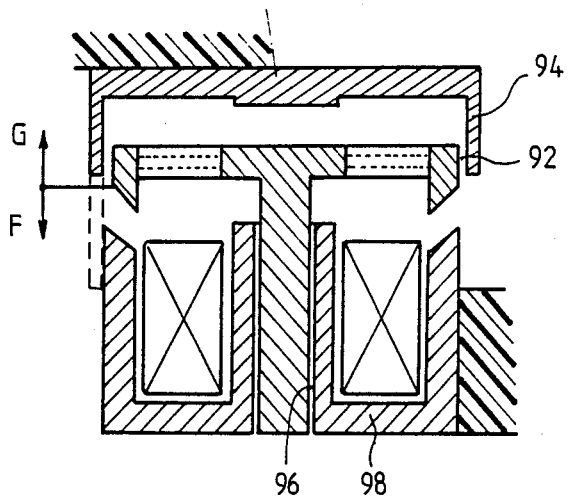

Variants 105, 106 may be obtained by forming structural combinations, see FIGS. 12 and 13, in which the two sliding air gaps of small reluctance are disposed, one 91 respectively 92 at the periphery of a first fixed and magnetizable piece 93 respectively 94, and the other 95 respectively 96 in a central region of a second magnetizable fixed piece 97 respectively 98.

In the embodiment shown in FIG. 12, one of the attraction air gaps, which is here moved away from the permanent magnet 100, has further been moved towards the bottom 99 of the fixed piece 97.

When the mobile armatures, such as 101 respectively 103 have the form of disks, as is the case in FIGS. 8 to 13, either a single permanent magnet 102 having an annular shape, see FIG. 14, may be used or else a multiplicity of permanent magnets which are fitted in pockets such as 104 respectively 105 and which may have circular 106 or respectively rectangular 107 shapes; in all the cases shown here, the axes of magnetization are radial.

It is further possible to give to the magnets mobile armatures having forms of revolution other non radial magnetization directions.

Figure 16:
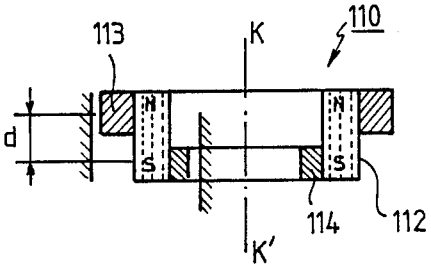
Figure 17:
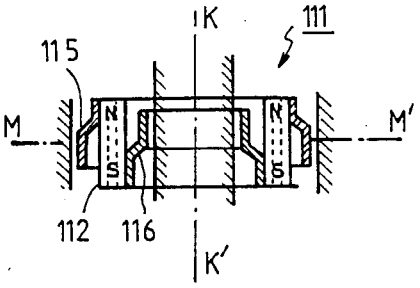

In FIGS. 16 and 17, the armatures 110 respectively 111 include the same type of annular magnet 112 in which the proportion of the height with respect to the mean diameter has been increased and where the magnetization direction NS is parallel to the axis of revolution KK'.

Solid pole pieces 113, 114 which may be associated with each of the magnetic poles along external and internal surfaces of the magnet, see FIG. 16, here lead to an axial shaft —d—of the sliding air gaps.

In FIG. 17, stamped or turned pole pieces 115, respectively 116 are associated with the permanent magnet 112 through narrowed portions respectively enlarged portions of their mean diameters so that the sliding air gaps are here disposed in a transverse mean plane MM' which is substantially the same as that of the magnet.

Comparable arrangements may of course be chosen when the mobile armatures do not have a form of reovlution, as is the case for FIGS. 1 to 7.

What is claimed is:

1. In a bistable polarized electromagnet having a fixed magnetizable circuit excited by a coil so as to give opposite magnetic polarizations to two pieces of this circuit placed facing each other, and a mobile armature which includes a permanent magnet whose internal flux flows parallel to these pieces and which moves between these two pieces so as to have a working air gap of variable thickness, and a sliding closure air gap of substantially constant thickness, placed in series with the first one, said closure air gap, which has a low reluctance conferred by a first pole piece fast with the magnet, is disposed in the vicinity of means for guiding the armature, said first pole piece, as well as a second pole piece fast with said magnet serving for channeling a holding flux in each of the two stable positions.

2. The electromagnet as claimed in claim 1, wherein one of the pole pieces of the armature has two extensions coperating respectively with one branch of a first fixed magnetizable circuit associated with the coil and the other with one end of a second fixed magnetizable circuit separate from the first one, these extensions each forming one of the faces of two substantially constant air gaps placed in series with two variable air gaps through which flows the flux developed by the coil.

3. The electromagnet as claimed in claim 2, wherein one of the pole pieces has an enlarged portion cooperating with a cross piece which magnetically connects together a branch of a first fixed magnetizable circuit and one end of a second magnetizable circuit, this enlarged portion carrying one of the faces of two contiguous substantially contant air gaps placed in series with the flux developed by the permanent magnet.

4. The electromagnet as claimed in claim 2, wherein said extensions, respectively enlarged portion, cooperate with the fixed circuit portions concerned through annular air gaps so as to cancel out the magnetic attractions perpendicular to the direction of movement of the armature.

5. The electromagnet as claimed in claim 2, wherein said fixed magnetizable circuits, said coils and said mobile armature have the form of solids of revolution about axes passing through said extensions, respectively through said cross piece.

6. The electromagnet as claimed in claim 2, wherein said fixed magnetizable circuits, said coils and said mobile armature have the form of solids of revolution about axes passing parallel to the direction in which the armature is displaced by a pole piece opposite that which carries the extensions, respectively enlarged portion.

7. The electromagnet as claimed in claim 1, wherein the permanent magnets have magnetization directions which are indifferently radial or axial with respect to the movement of the armature

* * * * *